US006865783B2

(12) United States Patent
Freiberg

(10) Patent No.: US 6,865,783 B2
(45) Date of Patent: Mar. 15, 2005

(54) STENTERING MACHINE

(75) Inventor: Helge Freiberg, Mönchengladbach (DE)

(73) Assignee: A. Monforts Textilmaschinen GmbH & Co., Mönchengladbach (DE)

( * ) Notice: Subject to any disclaimer, the term of this patent is extended or adjusted under 35 U.S.C. 154(b) by 0 days.

(21) Appl. No.: 10/486,857

(22) PCT Filed: Jun. 11, 2003

(86) PCT No.: PCT/DE03/01919

§ 371 (c)(1),
(2), (4) Date: Feb. 13, 2004

(87) PCT Pub. No.: WO03/106752

PCT Pub. Date: Dec. 24, 2003

(65) Prior Publication Data

US 2004/0231117 A1 Nov. 25, 2004

(30) Foreign Application Priority Data

Jun. 15, 2002 (DE) ..... 102 26 785

(51) Int. Cl.[7] ..... D06C 3/02
(52) U.S. Cl. ..... 26/89; 26/92; 26/96
(58) Field of Search ..... 26/87–93, 95, 26/96, 98, 106, 71–73, 51, 52, 53, 86; 264/288.4, 288.8, 289.3, 291, 290.2; 425/102, 75, 500, 503; 118/33, 34; 34/90, 619, 623, 660, 662, 664; 226/88, 102; 242/615.21; 28/165

(56) References Cited

U.S. PATENT DOCUMENTS 1,896,588 A * 2/1933 Laurie ..... 26/86
2,559,713 A * 7/1951 Dunski et al. ..... 34/421
3,418,702 A * 12/1968 Coburn ..... 26/91
3,471,606 A * 10/1969 Corbett ..... 264/209.5
3,551,970 A * 1/1971 Cohn et al. ..... 26/91
3,552,248 A * 1/1971 Pernick ..... 29/96
3,590,450 A * 7/1971 Pernick ..... 26/51.3
3,605,280 A * 9/1971 Fleissner ..... 34/115
3,995,457 A * 12/1976 Kinomoto et al. ..... 29/96
4,639,984 A * 2/1987 Langer ..... 26/89
4,817,254 A * 4/1989 Poterala ..... 26/96
5,394,595 A * 3/1995 Rutz ..... 26/93
5,862,574 A * 1/1999 Poterala ..... 26/89

FOREIGN PATENT DOCUMENTS

| | | |
|---|---|---|
| DE | 1087555 | 8/1960 |
| EP | 0073915 | 3/1983 |
| GB | 1319470 | 6/1973 |

OTHER PUBLICATIONS

Peter, M., and Rouette, H.–K.: Grundlagen der Textilveredlung [Fundamentals of Textile Finishing], Deutscher Fachverlag GmgH, Franfurt a.M., 1989. ISBN: 3–87150–277–4, p. 454–455, p. 673–675, and p. 709 to 711. To Follow.

"Appretur der Textilien" [Finishing of textiles], W. Bernard, Springer–Verlag, 2nd edition, 1967, pp. 120 to 123. To Follow.

* cited by examiner

*Primary Examiner*—Amy B. Vanatta
(74) *Attorney, Agent, or Firm*—Collard & Roe, P.C.

(57) ABSTRACT

A stentering machine having a drying zone and a pretreatment zone for coating a web of material on both sides and drying it is described. One aim consists of deflecting a web of material coated in the vertical position and stretched out in width, in order to introduce it into a conventional flat tenter frame, without damaging the coating. According to the invention, the web of material is needled into a pair of stentering chains having a predetermined chain pitch, and deflected from the vertical into the horizontal position on such a large arc that the difference between the sum of the chain pitches that form the arc chords and the arc length itself becomes small enough to be ignored.

5 Claims, 4 Drawing Sheets

STENTERING MACHINE

CROSS REFERENCE TO RELATED APPLICATIONS

Figure 1:
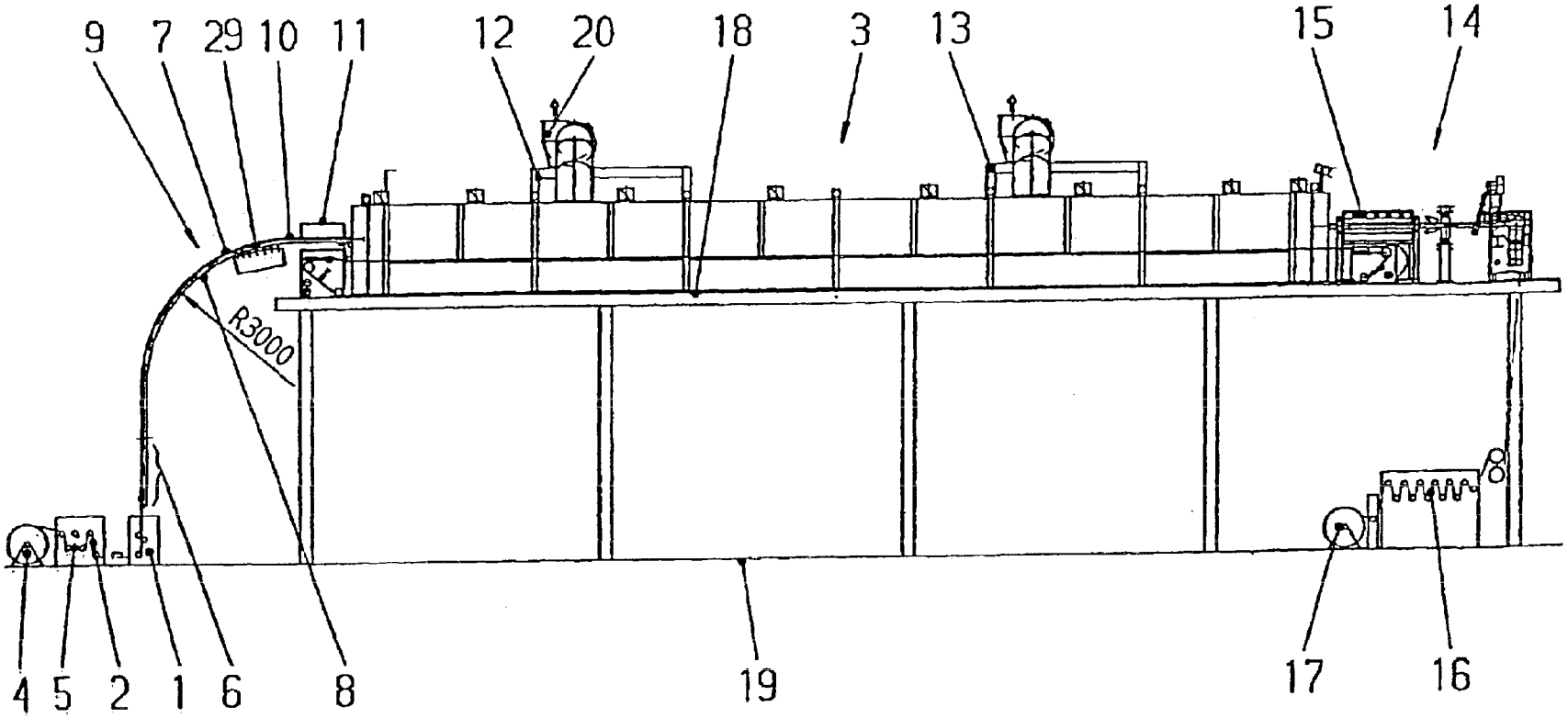

Applicant claims priority under 35 U.S.C. §119 of GERMAN Application No. 102 26 785.5 filed on Jun. 15, 2002. Applicant also claims priority under 35 U.S.C. §365 of PCT/DE03/01919 filed on Jun. 11, 2003. The international application under PCT article 21(2) was not published in English.

The invention relates to a stentering machine having a pretreatment zone and a drying zone for continuous treatment of a web of material spread out between stentering chains comprised of chain links, the two lengthwise edges of which are to be attached to the chain links in a coupling zone, in releasable manner, whereby each of the chain links possesses linking pins that are to be coupled with an adjacent chain link, in each instance, in pivoting manner, at the distance of the chain pitch, and whereby guide rails, which are horizontal in the drying zone, are assigned to the stentering chains. The stentering chains are endless. They are deflected with chain wheels, around shafts, ahead of the coupling zone (needling-in field) and behind an uncoupling zone (needling-out field), the axes of which stand perpendicular or parallel to the adjacent surface of the web of material. In the case of conventional flat tenter frames, one speaks, in this connection, of a horizontal or vertical chain deflection.

The aforementioned stentering machine is supposed to be suitable for drying a pretreated web of material, for example one coated on both sides, for example a web of textile material, or a web of material comprised of glass fibers or containing glass fibers, which was coated and/or dyed in a pretreatment zone.

Stentering machines, which are also referred to as stentering frames and serve for drying and fixing woven fabric and knitted fabrics, are described in the book: Peter, M., and Rouette, H.-K.: Grundlagen der Textilveredlung [Fundamentals of Textile Finishing], Deutscher Fachverlag GmbH, Frankfurt a. M., 1989. ISBN: 3–87150-277-4, p. 454–455, p. 673–675, and p. 709 to 711.

Coated webs of material are generally only allowed to be touched, for example deflected around rollers, once the coating has dried. Glass fibers frequently hold dyes more poorly than does the surface of the rollers usually used in textile machines, so that these are only supposed to touch the surface of the glass fiber web of material once the applied substance has dried.

There are tenter frame dryers having tenter chains comprised of chain links for a web of material stretched out between the stentering chains, e.g. a textile web of material. The web is held in needles or tenterhooks at its two lengthwise edges and passed through a drying zone and, if necessary, through a fixing zone. Placement of the edges of the web onto the needles or tenterhooks takes place in a needling-in zone or tenterhooking-in zone, a coupling zone for short. An example of such a flat frame is described in EP 00 73 915 B1. There are also machines of the stentering frame type, in which the web of material, held between one and the same pair of stentering chains, is passed over several levels (back and forth in a zigzag). At the lengthwise ends of each level of such a multi-level frame, the two stentering chains are deflected by approximately 180°, in each instance. Flat frames and multi-level frames are described in the book "Appretur der Textilien" [Finishing of textiles], W. Bernard, Springer-Verlag, $2^{nd}$ edition, 1967, pages 120 to 123.

As a rule, the stentering chains run in or on guide rails that absorb the weight of the stentering chain and the web of material they carry, on the one hand, as well as the crosswise tension exerted on the web of material (crosswise to the web transport direction), on the other hand. In the case of a normal flat tenter frame (having a single treatment plane), the guide rails lie essentially horizontally. In the case of a multi-level frame, the guide rails can be deflected at the ends of each level, on a short arc, so that stentering chain guidance is present everywhere on the path of the stentering chain, in each instance.

In devices in which a running web of material is to be coated on both surfaces, the web is drawn through the coating unit in perpendicular manner, from the bottom to the top. The vertical web guidance has the advantage that the coating conditions are the same on both web surfaces, in contrast to horizontal web guidance. Since the freshly coated surface of the web is only allowed to be touched after it has dried, the material, after having come out of the coating unit, is first passed through a dryer arranged perpendicular above the latter. The method of procedure is very similar for the drying of freshly dyed glass fiber webs.

In the case of some grades of webs of material coming vertically from pretreatment, there is the need to control the web width during drying. The web of material can then be needled into or tenterhooked into stentering chains and stretched to a specific width. A web of material coated on both sides and held in the stentering chains is passed through a dryer essentially arranged vertically above the coating unit. The web of material (which generally is moved continuously) is supposed to remain in the dryer until it has dried, and can be deflected using rollers, without any danger for the coating. In this connection, drying speeds that are somewhat economically efficient presuppose very high vertical dryers with stentering chains.

Such special dryer designs require very high spaces. In a facility having a height of twelve meters, there is hardly more than six meters space for the dryer itself, since a large part of the overhead height is needed for the coating unit and the coupling zone (e.g. needling-in zone). If a coating of a web of material being moved continuously is supposed to be dried on a path of six meters, the speed can only be very low. The output of such a machine is also low. According to the concept described, greater drying speeds only become possible if the factory building that is available is higher. Very high buildings are rare, however, or would have to be built for a special case. Therefore the output of the machine, in each instance, remains limited, measured in web meters/time unit, because it is not possible to build factory towers of any desired height. Furthermore, since such vertical dryers are only used relatively rarely, special designs of the machines are not worthwhile.

Completely different possibilities would result if it were possible to carry out the drying of the web of material on a conventional tenter frame having a single horizontal drying plane (flat frame) of practically any desired length. However, a web of material can only be coated in the same manner on both sides if it is drawn out of the coating unit vertically upwards, and is not deflected on a roller before having dried completely.

If such a freshly coated web, held at the edges in stentering chains, were to be deflected without surface contact (on a roller), similar to the case of a multi-level frame, it would have to be accepted that the freshly applied coating would be compressed on the inside of the deflection curve and/or would crack on the outside of the deflection curve.

The invention is based on the task of deflecting the freshly coated web of material, in each instance, without roller contact, from the vertical web path (in the coating unit) to the horizontal web path (in a conventional flat tenter frame), without having to accept the risk of cracking or compression of the freshly applied coating. It is also the aim of the invention to deflect the web of material, held in stentering chains, in such a manner that it can be dried not, as before, in a dryer having a vertical web path, but rather on a conventional stentering frame having horizontal web guidance. For reasons of costs, it is also considered important to be able to use a standard flat stentering frame having usual stentering means (needles or tenterhooks) on the chain links.

For the stentering machine mentioned initially, the solution according to the invention consists of the fact that in the case of a pretreatment zone and vertical web guidance provided in the coupling zone, a 90° deflection zone of the stentering chains on guide rails that are curved, preferably in circular manner (from the vertical to the horizontal), with a smooth transition into the horizontal guide rail course of the drying zone follows no later than subsequent to the coupling zone, and that in the deflection zone, the arc segment of the guide rails that corresponds to each chain link is at most approximately 1% longer than the related chord. This has the result that the (average) radius of curvature of the guide rails in the deflection zone is so great that the web of material is practically not stretched when passing through the deflection zone. "Practically not stretched" means that the quality of the resulting web of material, coating, or dye, in each instance, lies within the permissible tolerance in each individual case.

Preferably, the arc segment of the guide rails corresponding to each chain link in the deflection zone is supposed to be at most approximately 0.1% longer than the related chord. In other words, the length difference between the arc, in each instance, and the related chord is only supposed to be so great that noticeable disruptive damage (cracking or wrinkling) of the (fresh) coating and/or dye is not to be expected. Some improvements and other embodiments of the invention are described in the dependent claims.

Preferably, the invention is implemented in that the web of material is first needled in or tenterhooked in in a vertically arranged running-in field or coupling field, having a height of two meters, for example; in the case of a vertical coupling field, needling-in is generally preferred to tenterhooking-in.

After the edges of the web of material have been attached, the stentering chains, with the material, are deflected by 90° into the horizontal position of the surface of the web of material, using the curved guide rails. The radius of curvature of the guide rails is supposed to be very great and amount to approximately 3000 mm, for example. This achieves the result that the length of the arc formed by the guide rails is practically identical with the length of the sequence of chords defined by the chain pitch (e.g. about 120 mm), i.e. of the draft of traverse formed by the chords. In the case of the example mentioned, with a chain pitch of 120 mm and a radius of curvature (curving radius) of 3000 mm, there are always approximately 39 chain links on the deflection arc as the draft of traverse, at any one time. The length difference between the arc over 90° (4,710 mm) and the draft of traverse having 39 chain links is only about 0.3 mm. When the web of material is deflected in the arc defined according to the invention, the material stretches by a total of at most 0.3 mm over the entire arc. Such slight expansion, in terms of amount, will not have the result that the coating (which is still damp on both sides) will crack or wrinkle.

In the case of deflection of the web of material, according to the invention, from the vertical coating part to the horizontal drying part, the length of the drying chamber can be freely selected in accordance with the desired production speed, since there is no limit resulting from the building height that must be taken into consideration. By means of the use of the device according to the invention for contact-free 90° deflection of the web of material guided in stentering chains, the same production speeds and production conditions can be achieved as in the case of coating processes in which the web of material is guided horizontally over a coating unit having a flat tenter frame dryer that lies behind it in the transport direction.

One aim of the invention consists, as already mentioned, of deflecting a web of material coated in the vertical position and stretched out in width, in order to introduce it into a conventional flat tenter frame, without damaging the coating. According to the invention, the web of material is needled into a pair of stentering chains having a predetermined chain pitch, and deflected from the vertical into the horizontal position on such a large arc that the difference between the sum of the chain pitches that form the arc chords and the arc length itself becomes small enough to be ignored. In other words, it can also be said that the radius of curvature of the guide rails is supposed to be so great, in the deflection zone, i.e. the distance between two adjacent linking pins of the chain links, i.e. the chain pitch, is supposed to be so small that the difference in length of the arc, particularly a 90° arc, of the deflection zone practically becomes zero in comparison with the draft of traverse formed by the chain links located in the deflection zone. "Practically zero" in this connection is supposed to mean that the quality, in each instance, is fulfilled within the precision requirements.

If there should be the risk, in an individual case, in the end region of the deflection arc according to the invention, that the web of fabric might hang down between the two stentering chains, the web surface can be supported with air cushions directed into the deflection region, radially from the inside with regard to the arc.

Figure 2:
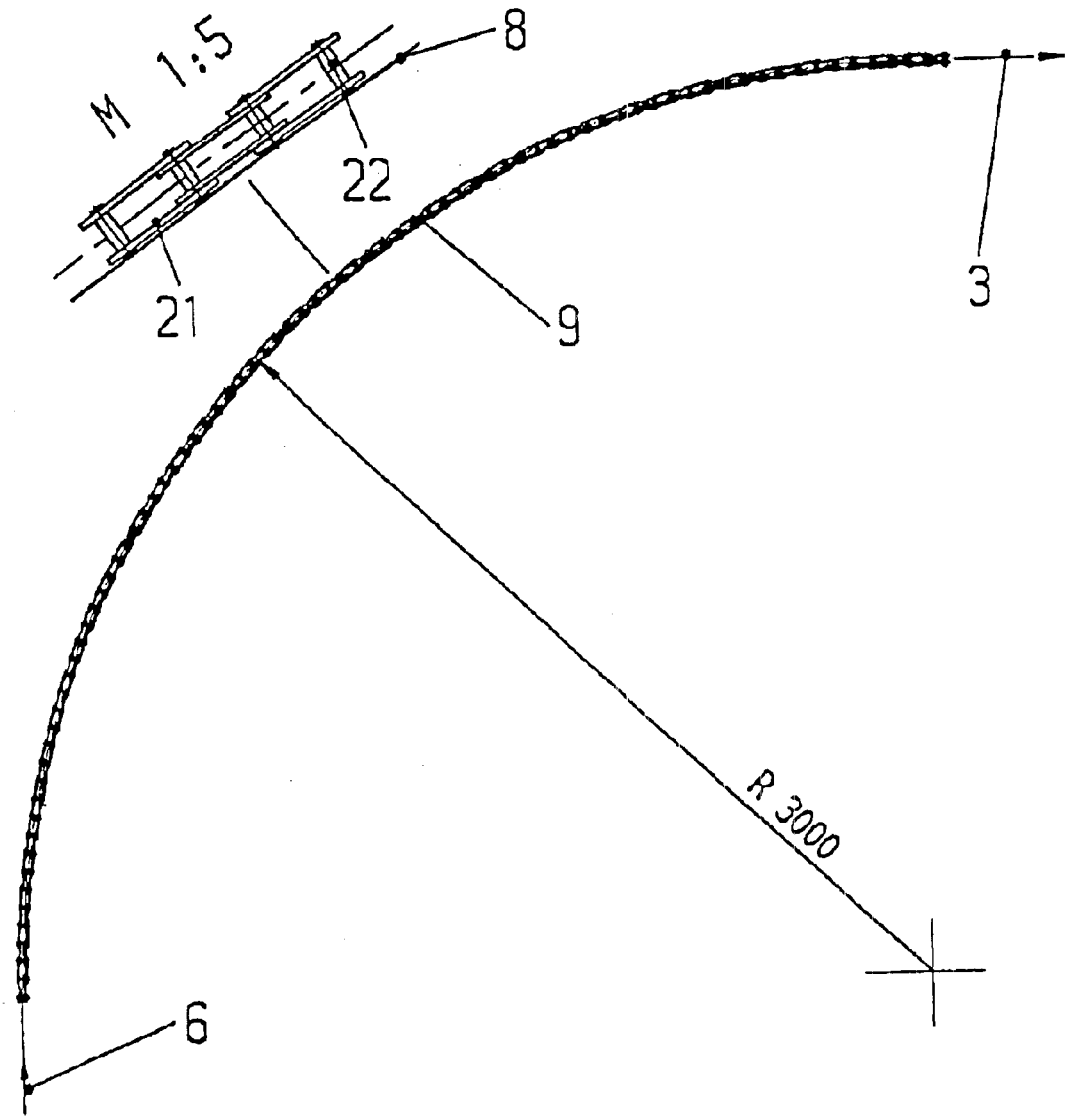
Figure 3:
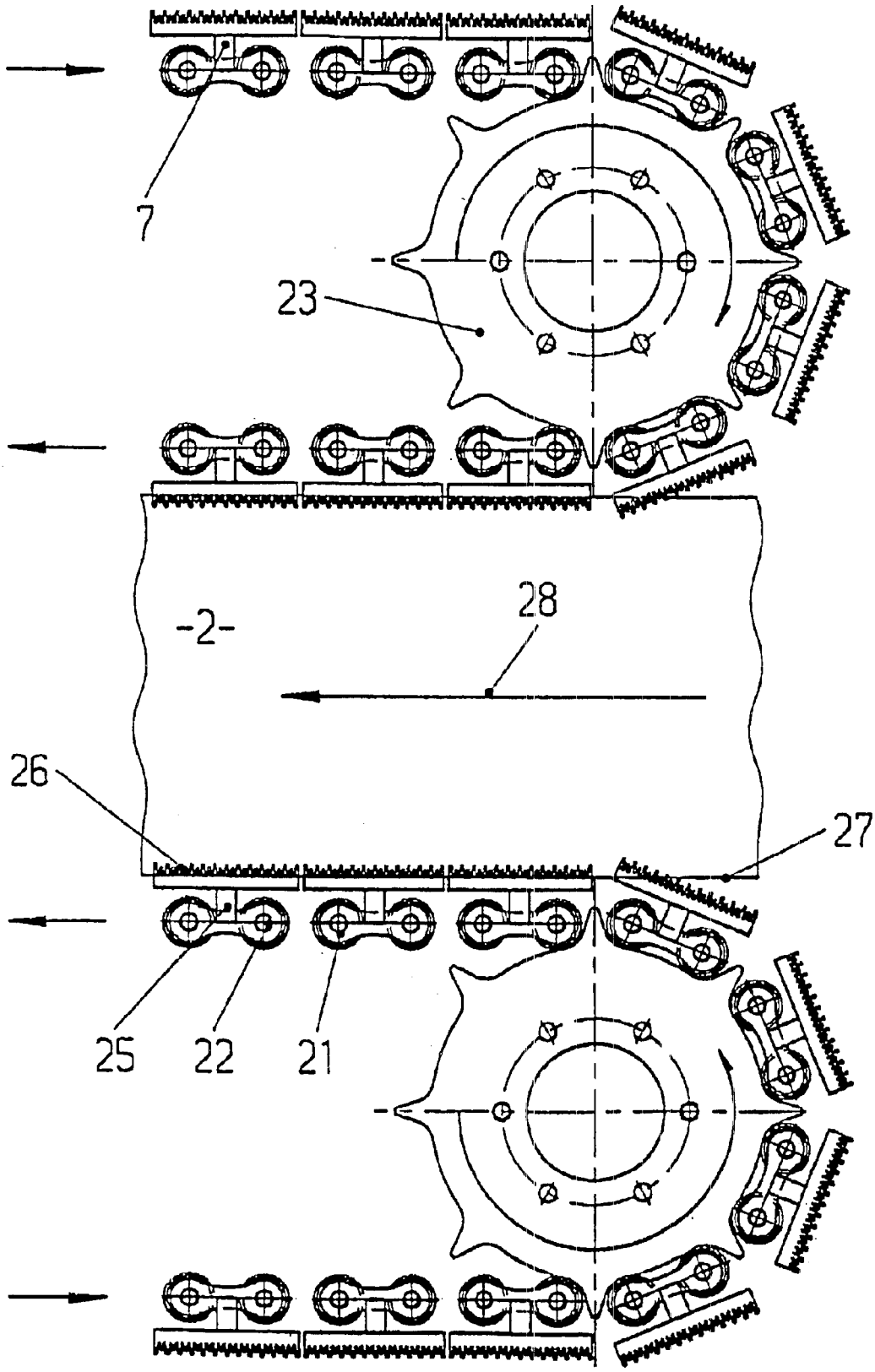
Figure 4:
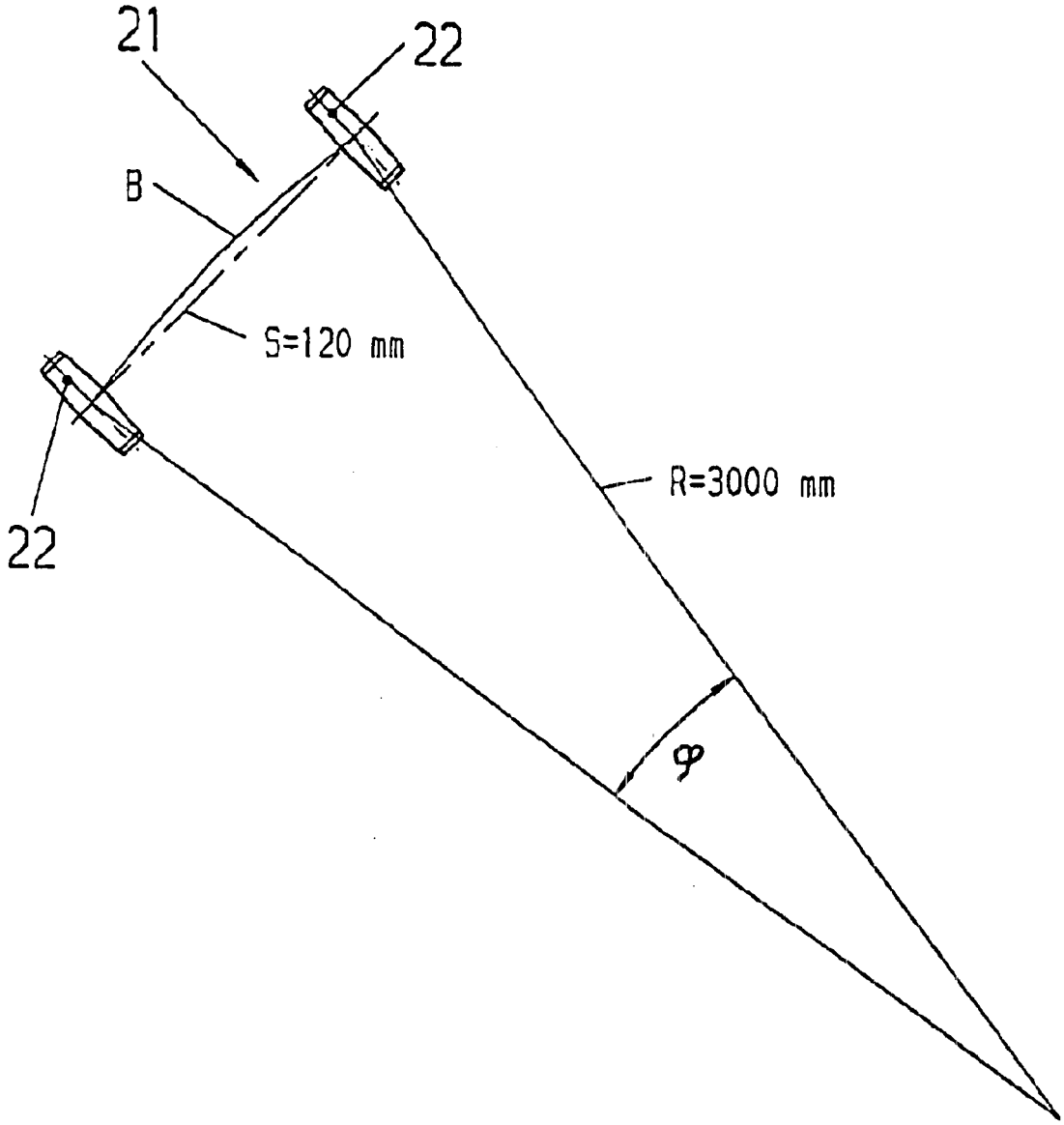

Using the schematic representation of an exemplary embodiment, details of the invention will be explained. The drawings show:

FIG. 1 a crosswise cross-section through a device according to the invention, with a horizontal flat tenter frame and a prior vertical coating unit;

FIG. 2 a representation of the deflection curve according to FIG. 1;

FIG. 3 a fundamental drawing of a view of FIG. 2 from the left, with chain deflection about axes that stand perpendicular to the web of material; and FIG. 4 an ancillary drawing for calculating the difference between the length of the deflection arc and the draft of traverse of the tenter frame chain.

FIG. 1 shows an exemplary embodiment of a device having a coating unit 1 for coating a web of material 2 on both sides, with subsequent drying of the coating in a tenter frame dryer 3. The web of material 2 is guided from the roller 4 into the coating unit 1, by way of web tension regulators 5. There, the web of material 2 is coated on both sides and drawn vertically upward through a needling-in field 6 (coupling zone). Here, the edges of the web of material are attached to stentering chains 7, which run in guide tracks 8. For this purpose, the chain links of the stentering chains 7 can be equipped with conventional needle strips, in other words needle strips that have been used until now, in standard production. In the exemplary embodiment, the needling-in field 6 has a vertical length of approximately two meters, subsequent to the coating unit 1.

The needling-in field 6 is followed by a deflection zone 9 in the shape of a quarter circle, the radius of curvature R of which is supposed to amount to approximately three meters. The deflection zone 9 can open into the drying fields 12, 13, etc., of a conventional tenter frame dryer 3, at its top end 10, horizontally, directly or after passing through an inspection zone 11, for example one with a length of 2000 mm. The stentering frame dryer 3 can usually possess one, two, three, or more such drying fields 12, 13. In the exemplary embodiment, the drying fields are followed by a run-out zone 14, for example having a needling-out field 15 and web tension regulators 16, as well as a wind-up roller 17. At the dimensions indicated, the bottom 18 of the tenter frame dryer 3 lies about 5,500 mm above the floor 19 of the production facility (on which the coating unit 1 also stands), while the greatest height (here, that of the fans 20) of the system is approximately 9000 mm. Production facilities of this height are normal.

FIG. 2 shows a representation of the deflection zone 9 of FIG. 1, while FIG. 3 is a fundamental drawing of a view of FIG. 2 from the left. FIG. 2 shows three chain links 31 with linking pins 22, as well as a deflection arc 9 having the radius of curvature R, and a plurality of chain links 21, shown on a larger scale for a better illustration. If the radius of curvature in the original is R=3000 mm and the chain pitch in the original is S=120 mm, the difference between the distance from linking pin 22 to linking pin 22 along the deflection arc 9 practically cannot be represented in the drawing according to FIG. 2, in terms of amount, on the one hand, and along the chord, on the other hand. For this reason, FIG. 4 shows an ancillary drawing of a circle sector having the center point angle $\phi$ and the radius R, which corresponds to the arc length B from linking pin 22 to linking pin 22 and the chord S, which is measured along a chain link 21 between the linking pins 22. For the values R=3000 mm and S=120 mm (=chain pitch), there is a difference $\Delta=B-S$ of about 0.008 mm for a chain link 21, in other words a length difference of about 0.3 mm for the entire deflection arc 9 with about 39 chain links between the sum of the geometric arc segments and the draft of traverse formed by the chain lines 21, i.e. the chords S.

The same geometrical conditions also hold true for the plan of the needle strips or tenterhook tables, if care is taken to ensure that the arrangement of the needle strips and the tenterhook table is made approximately on the "partial arc," so to speak, on which the chain links (21) pass through the guide rail (9) in the deflection zone (8).

FIG. 3 is a fundamental drawing of the view of the 90° arc of the deflection zone 9 according to FIG. 2 from the left. The stentering chains 7 are passed over deflection wheels 23 in endless manner. The axes 24 of the deflection wheels 23 stand approximately horizontally in FIG. 3. The same holds true in the needling-in field 6, essentially, for the linking pins 22. In the deflection zone 9, the axes of the linking pins 22 are gradually brought from the horizontal to the vertical position. On each chain link 21, there is a needle holder 25 with needles 26, which are to be hooked onto the two edges 27 of the web of material 2 in the needling-in field 6, in the exemplary embodiment. In the perspective of FIG. 3, the mutual distance between linking pin to linking pin 22 decreases in the transport direction 28 of the web of material 2 from the bottom to the top. The web 2 can be supported with an air cushion 29 (FIG. 1) in the region of the deflection zone 9.

Reference Symbol List:

| | |
|---|---|
| 1 = | coating apparatus |
| 2 = | web of material |
| 3 = | tenter frame dryer |
| 4 = | roller |
| 5 = | web tension regulator |
| 6 = | needling-in field |
| 7 = | stentering chain |
| 8 = | guide rail |
| 9 = | deflection zone |
| 10 = | top end (9) |
| 11 = | inspection zone |
| 12, 13 = | drying field |
| 14 = | run-out zone |
| 15 = | needling-out field |
| 16 = | web tension regulator |
| 17 = | wind-up roller |
| 18 = | bottom (3) |
| 19 = | factory floor |
| 20 = | fan |
| 21 = | chain link |
| 22 = | linking pin |
| 23 = | deflection wheel |
| 24 = | axis (23) |
| 25 = | needle chain |
| 26 = | needle |
| 27 = | edge of web of material |
| 28 = | transport direction |
| 29 = | air cushion |

What is claimed is:

1. Stentering machine having a pretreatment zone (1) and a drying zone (3) for continuous treatment of a web of material (2) spread out between stentering chains (7) comprised of chain links (21), the two lengthwise edges (27) of which are to be attached to the chain links in a coupling zone (6), in releasable manner, wherein each of the chain links (21) possesses linking pins (22) that are to be coupled with an adjacent chain link, in each instance, in pivoting manner, at the distance of the chain pitch (5), and wherein guide rails (8), which are horizontal in the drying zone (3), are assigned to the stentering chains (7), wherein in the case of a pretreatment zone (1) and vertical web guidance provided in the coupling zone (6), a 90° deflection zone (9) of the stentering chains (7) on guide rails (8) that are curved, with a smooth transition into the horizontal guide rail course of the drying zone (3) follows the coupling zone (6), and that in the deflection zone (9), the arc segment (B) of the guide rails (8) that corresponds to each chain link (21) is at most approximately 1% longer than the related chord (S).

2. Stentering machine according to claim 1, wherein the arc segment (B) of the guide rails (8) that corresponds to each chain link (21) is only approximately 0.1% longer than the related chord (S) in the deflection zone (9).

3. Stentering machine according to claim 1, wherein the guide rails (8) are curved in a circular shape in the region of the deflection zone (9).

4. Stentering machine according to claim 1, wherein that the radius of curvature of the guide rails (8) is so great, in the deflection zone (9), i.e. the distance between two adjacent linking pins (22) of the chain links (21), i.e. the chain pitch, is so small that the difference in length of the arc of the deflection zone is practically zero in comparison with the draft of traverse formed by the chain links (21) located in the deflection zone (9).

5. Stentering machine according to claim 1, wherein an air cushion (29) is assigned to the web of material (2) as a carrying support, at least in the deflection zone (3).

* * * * *